United States Patent [19]

Evers et al.

[11] Patent Number: 5,065,649

[45] Date of Patent: Nov. 19, 1991

[54] DEVICE FOR HOLDING FASTENERS

[75] Inventors: David E. Evers, Leawood, Kans.; Charles A. Milburn, Kansas City, Mo.

[73] Assignee: Bulter Manufacturing Company, Grandview, Mo.

[21] Appl. No.: 570,524

[22] Filed: Aug. 21, 1990

[51] Int. Cl.[5] ..... B25B 23/08

[52] U.S. Cl. ..... 81/458; 81/120; 81/125

[58] Field of Search ..... 81/125, 451, 456, 458, 81/53.11, 120

[56] References Cited

U.S. PATENT DOCUMENTS

| | | | |
|---|---|---|---|
| 797,078 | 8/1905 | Shelton | 81/456 |
| 1,360,500 | 11/1920 | Coll | 81/458 |
| 2,723,694 | 11/1955 | Ross | 81/451 |
| 3,245,446 | 4/1966 | Morifuji | 81/125 X |
| 3,253,485 | 5/1966 | Grote | 81/125 X |
| 3,351,111 | 11/1967 | Biddle | 81/125 X |

*Primary Examiner*—James G. Smith

*Attorney, Agent, or Firm*—Shoemaker and Mattare, Ltd.

[57] ABSTRACT

A screw holding device of elastic material is provided having a tube-shaped top end and a dome-shaped bottom end for fitting securely over the head of a screw or bolt to insure the availability of the screw or bolt by its being held securely in the dome end's interior multiple gripping means which are easily releasable when the screw or bolt is seated.

1 Claim, 1 Drawing Sheet

DEVICE FOR HOLDING FASTENERS

BACKGROUND OF THE INVENTION

This invention relates to screw holding devices and to devices which hold bolts such as machine-type bolts.

In the building and construction trades, it is a commonplace occurrence to find, align and secure screws, bolts and other fasteners in an expeditious and simple manner. It is necessary to do so in many instances in less than optimal lighted areas of somewhat limited space and particularly where the use of two hands is not feasible or the use of one hand is desirable. Further, the alignment of the tool head, such as a screwdriver, to the securing device, such as a screw, bolt and the like, should be made as precisely as possible to avoid problems such as stripping, burring and the like. This is particularly important in the use of color-coated or plastic-coated screw heads, bolt heads and the like where an intact securing screw must blend into its final resting place in shape and color.

The use of screw holding devices is not new and there are various complex devices for attempting to achieve such results. For example, U.S. Pat. No. 739,606 provides for a spring actuated device having prongs or fingers for enclosing the screw head and a slidable and fixed sleeve. U.S. Pat. No. 3,245,446 discloses various elastic screw holding devices alone and in combination with a screwdriver. One embodiment comprising radially projecting teeth-like holders for the screw heads is contained with an elliptically shaped device.

In another device, described in U.S. Pat. No. 2,985,208, and designed to overcome the unsatisfactory use of non-magnetic screws and tool heads, ribs are provided for the cylindrical body which slides over the screwdriver shaft and recessed spherical receiving portion for holding the screw head, and further provided with circumferentially spaced, longitudinally extending slits. These permit an outward, splaying movement to engage the screw head. Finally, in U.S. Pat. No. 3,351,111, there is described a complex tool which comprises gripping means for attaching to screw nut and bolt heads.

It has been found that such shapes such as ellipses and teeth and finger-like gripping devices have less than satisfactory results when used with painted surfaces which must remain unmarred and particularly with glossy, smooth dome shaped screw heads and bolts, where elliptical shaped holders make minimal contact with the domed and circular screw cap.

Nowhere is there suggested or taught the use of an elastic, recessed, receiving device for holding and securing the head of a screw, bolt or fastener which may be magnetic or non-magnetic and which utilizes a series or at least one or more circular ribs to fully engage the head of the fastener. This is particularly advantageous in the use of fastening devices which have a head or cap as shown in the drawings hereafter having a grooved configuration perpendicular to the direction of the screw itself and contained within and below the cap of the screw or bolt.

SUMMARY OF THE INVENTION

It has now been found that unexpectedly good results are obtained with a securing elastic device (1), capable of attachment over the shaft of a screwdriver (7), and comprising an elastic recessed dome-shaped end (2) adapted and shaped (8) to receive and secure the head of a fastening device such as a screw (9), bolt and the like. This device contains at least one interior annular rib (3) and a hollow circular ridge therebetween (10), extending radially between the rib or ribs and the bottom of the dome end. In this manner and by its unique configuration, the head of the secured device, i.e., the bolt (6), is engaged completely in a multi-circular fashion and in a continuous manner over the bolt or screw face in addition to the driving head into which screwdriver fits.

The shoulder of the bolt or screw is held in place by the cap retaining groove or tooth gripping interior lip (4) and flange which also comprises the bottom edge of the shaped dome. The device is effective in holding the screw within the dome-shaped end until it is securely screwed in place and is seated, at which time the cap is easily loosened and disengaged from the cap retainer groove.

It is an object of the present invention to provide an adapter for holding a fastener such as a screw, bolt and the like in the absence of a magnetic attraction which will facilitate the fastening process.

It is still another object of this invention to provide a screw adapter which will aid in the fastening process without marring the decorative surface of the screw head.

It is yet another object of this invention to provide an elastic or pliable device for holding screws and bolts in place for mounting connected to a screwdriver in which the device is adapted to hold the screw or bolt head by means of a circumferentially placed rib contained inside a formed dome, shaped to accommodate the head of the bolt or screw.

It is still another object of this invention to provide an elastic holder which fits onto and holds securely inside its dome-shaped adapting end, the head of a screw or bolt whose head or top, containing recesses for a manual or power screw-driving device, is shaped to generally fit into the dome shape and is further held by the ringed configuration contained therein.

These and other objects of my invention will become more readily understandable to those skilled in the art from a careful reading of the specification, claims and drawings which follow.

DETAILED DESCRIPTION OF THE PREFERRED EMBODIMENTS

Figure 1:
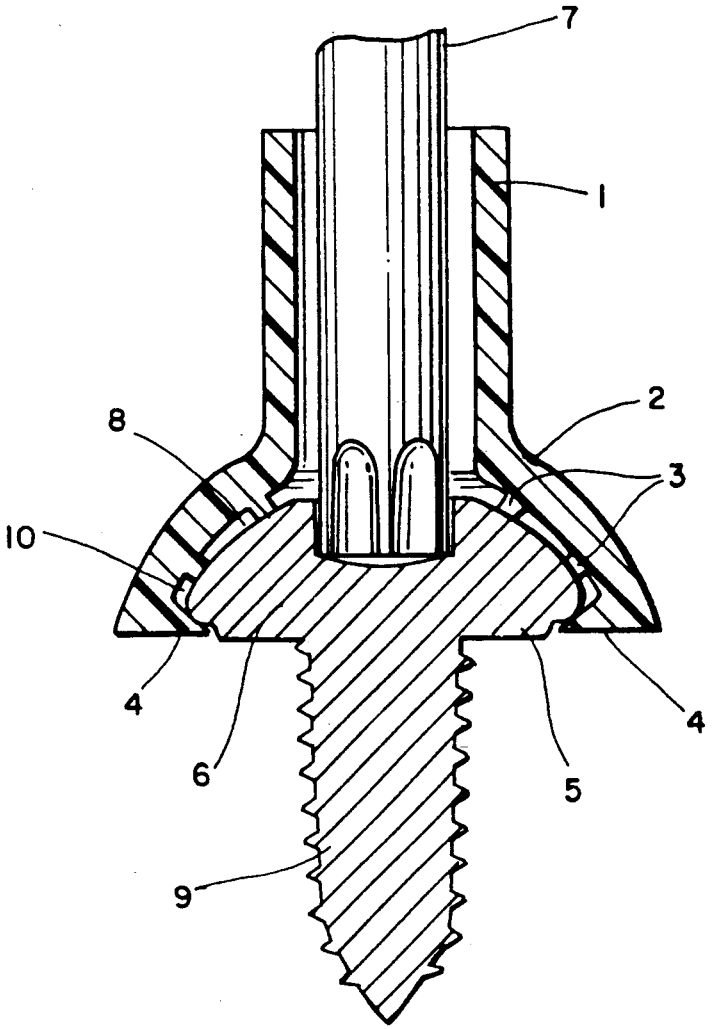
FIG. 1 is a diagramatic cross-sectional view of the essential part of this invention including a representative screw.

A preferred embodiment of the invention comprises a pliable, elastic, tubular member (1) such as rubber, neoprene, polyethylene, or suitable plastic such as ethylene vinyl acetate copolymer having an opening into which the shaft of a screwdriver can fit and be placed (7). At the opposite end of the opening is a round, dome-shaped bottom (2) having inside the dome at least one circular rib (3) of about 1/64" to 1/32" projection interspaced with the flush interior dome surface (8). The distance between the ribs can vary because their principal purpose is to fit securely onto surfaces provided and necessitated by the shape, form member and configuration of the fastener, such as screw, bolt and the like (6). For example, should the bolt to be inserted have only one shoulder, then the dome interior would have only one interior rib, with a hollow interior dome surface between the rib and the bottom end (10).

Because the dome-shaped end is plastic and pliable, it easily conforms to the shape of the object used to secure, such as the bolt, screw and the like (9). The tooth-shaped internally projecting lip (4) serves to push on the screw head to maintain a tight fit actually pushing it against the interior surface of rib (3).

In this manner, minor manufacturing tolerance or variations can be accounted for and the screw is still held tightly.

In a preferred example of one embodiment, a painted capped fastener identified by the trademark "Scru-Bolt" of the Butler Manufacturing Company. This screw had the six-pointed configuration adaptable to the Torx ® line of tools, a trademarked line of products of the Cam Car Division of the Townsend Corporation as shown in FIG. 1. Similar good results are obtained with other head configurations such as Allen, Phillips, straight slot and the like.

The invention has been described as fully set forth above but it will be understood that various modifications are contemplated without departing from the scope and spirit of the present invention. In particular the device of the present invention is adaptable to a large variety of screws, fasteners and screw driving devices.

What is claimed is:

1. A device for holding a fastener by its head, comprising a tubular member having at one end a pliable dome-shaped enlargement, said enlargement having an interior surface and terminating at a bottom end surface, an annular, internally projecting lip, adjacent said end surface, said lip having an oblique upper surface for engaging the fastener head along its bottom outer edge, and at least one annular rib projecting obliquely downward from the interior surface of the enlargement, intermediate said tubular member and said internal lip, for engaging an upper surface of the fastener head, and thereby gripping the head between the annular rib and the upper surface of the internal lip.

* * * * *